US008372179B2

(12) United States Patent
Barnes et al.

(10) Patent No.: US 8,372,179 B2
(45) Date of Patent: Feb. 12, 2013

(54) ORE REDUCTION PROCESS USING CARBON BASED MATERIALS HAVING A LOW SULFUR CONTENT AND TITANIUM OXIDE AND IRON METALLIZATION PRODUCT THEREFROM

(75) Inventors: John James Barnes, Hockessin, DE (US); Stephen Erwin Lyke, Wilmington, DE (US); Dat Nguyen, Chadds Ford, PA (US); Joseph M. Shekiro, Jr., Newark, DE (US); Guangliang Liu, Wilmington, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 298 days.

(21) Appl. No.: 12/680,393

(22) PCT Filed: Oct. 14, 2008

(86) PCT No.: PCT/US2008/079761

§ 371 (c)(1),
(2), (4) Date: Mar. 26, 2010

(87) PCT Pub. No.: WO2009/052066

PCT Pub. Date: Apr. 23, 2009

(65) Prior Publication Data

US 2010/0237280 A1 Sep. 23, 2010

Related U.S. Application Data

(60) Provisional application No. 60/999,005, filed on Oct. 15, 2007.

(51) Int. Cl.

| | |
|---|---|
| ***C22B 1/16*** | (2006.01) |
| ***C22B 7/04*** | (2006.01) |
| ***C21B 13/10*** | (2006.01) |

(52) U.S. Cl. ..... 75/435; 75/485; 75/771

(58) Field of Classification Search ..... 75/435, 75/485, 771

See application file for complete search history.

(56) References Cited

U.S. PATENT DOCUMENTS

RE21,651 E * 12/1940 Rice et al. ..... 208/126
2,488,439 A 11/1949 Schaumann (Continued)

FOREIGN PATENT DOCUMENTS

GB 1087027 10/1967
GB 1491519 11/1977

(Continued)

OTHER PUBLICATIONS

"New Coal-Based Process to Produce High Quality DRI for the EAF" Sawa et al., Technical Research Laboratories, Kawasaki Steel Corporation ISIJ International, vol. 41 (2001), Supplement, pp. S17-S21.

*Primary Examiner* — George Wyszomierski
*Assistant Examiner* — Tima M McGuthry Banks

(57) ABSTRACT

The present invention is one or more processes for producing separable iron and titanium oxides from an ore comprising titanium oxide and iron oxide, comprising: (a) forming agglomerates comprising carbon-based material and the ore, the quantity of carbon of the agglomerates being at least sufficient for forming a ferrous oxide-containing molten slag, at an elevated temperature; (b) introducing the agglomerates onto a bed of carbon-based material in a moving hearth furnace, wherein the carbon-based materials used for both the agglomerates and the bed have a low sulfur content; (c) heating the agglomerates in the moving hearth furnace to a temperature sufficient for liquefying the agglomerates to produce a liquid comprising ferrous oxide-containing slag; (d) metallizing the ferrous oxide of the slag by reaction of the ferrous oxide and the carbon of the carbon bed at a furnace temperature sufficient for maintaining the slag in a liquid state; (e) solidifying the slag after metallization of the ferrous oxide to form a matrix of titanium oxide-rich slag having a plurality of metallic iron granules distributed there through; and (f) separating the metallic iron granules from the slag, the slag comprising greater than 85% titanium dioxide based on the entire weight of the matrix after separation of the metallic iron.

20 Claims, 8 Drawing Sheets

U.S. PATENT DOCUMENTS

| | | | | |
|---|---|---|---|---|
| 2,488,440 | A | 11/1949 | Schaumann | |
| 2,885,280 | A | 5/1959 | Greffe | |
| 3,218,152 | A | 11/1965 | Sasabe | |
| 3,759,693 | A | 9/1973 | Kunii et al. | |
| 3,850,615 | A | 11/1974 | Reeves | |
| 3,853,536 | A | 12/1974 | Tylko | |
| 3,865,574 | A | 2/1975 | Long et al. | |
| 3,957,482 | A | 5/1976 | Whigham | |
| 4,032,120 | A | 6/1977 | Beggs | |
| 4,032,352 | A | 6/1977 | Pietsch | |
| 4,049,441 | A | 9/1977 | Jaco, Jr. et al. | |
| 4,054,443 | A | 10/1977 | Jaco, Jr. | |
| 4,087,275 | A | 5/1978 | Beggs | |
| 4,116,679 | A | 9/1978 | Pietsch | |
| 4,144,052 | A | 3/1979 | Serbent et al. | |
| 4,176,041 | A | 11/1979 | Mori et al. | |
| 4,251,267 | A | 2/1981 | Beggs et al. | |
| 4,257,806 | A | 3/1981 | Fujita et al. | |
| 4,270,739 | A | 6/1981 | Ahrendt et al. | |
| 4,381,939 | A | 5/1983 | Ahrendt et al. | |
| 4,470,581 | A | 9/1984 | Ahrendt et al. | |
| 4,685,964 | A | 8/1987 | Summers et al. | |
| 4,701,214 | A | 10/1987 | Kaneko et al. | |
| 4,702,766 | A | 10/1987 | Love et al. | |
| 4,900,356 | A | 2/1990 | Hoffman | |
| 5,435,831 | A | 7/1995 | Meissner | |
| 5,601,631 | A | 2/1997 | Rinker et al. | |
| 5,674,308 | A | 10/1997 | Meissner et al. | |
| 5,730,775 | A | 3/1998 | Meissner et al. | |
| 5,782,957 | A | 7/1998 | Rinker et al. | |
| 5,865,875 | A | 2/1999 | Rinker et al. | |
| 5,873,925 | A | 2/1999 | Rinker et al. | |
| 5,885,521 | A | 3/1999 | Meissner et al. | |
| 5,997,596 | A | 12/1999 | Joshi et al. | |
| 6,036,744 | A | 3/2000 | Negami et al. | |
| 6,187,076 | B1 | 2/2001 | Sugahara et al. | |
| 6,214,087 | B1 | 4/2001 | Hoffman et al. | |
| 6,251,156 | B1 | 6/2001 | Hoffman et al. | |
| 6,368,379 | B1 | 4/2002 | Tateishi et al. | |
| 6,413,295 | B2 | 7/2002 | Meissner et al. | |
| 6,582,491 | B2 | 6/2003 | Hoffman et al. | |
| 6,630,010 | B2 | 10/2003 | Ito et al. | |
| 6,685,761 | B1 * | 2/2004 | Hoffman et al. | 75/10.63 |
| 2001/0025549 | A1 | 10/2001 | Tanigaki et al. | |
| 2001/0027701 | A1 | 10/2001 | Ito et al. | |
| 2001/0052273 | A1 | 12/2001 | Meissner et al. | |
| 2001/0054329 | A1 | 12/2001 | Hoffman et al. | |
| 2002/0114761 | A1 | 8/2002 | Akhtar et al. | |
| 2005/0028643 | A1 | 2/2005 | Tanaka et al. | |
| 2006/0278040 | A1 | 12/2006 | Harada et al. | |
| 2010/0285326 | A1 * | 11/2010 | Barnes et al. | 428/552 |

FOREIGN PATENT DOCUMENTS

| | | |
|---|---|---|
| GB | 2189260 | 10/1987 |
| JP | 54040201 | 1/1977 |
| JP | 52108312 | 9/1977 |
| JP | 63042351 | 2/1988 |
| JP | 01031911 | 2/1989 |
| JP | 03060883 | 9/1991 |
| JP | 2000045007 | 2/2000 |
| JP | 2000239752 | 9/2000 |
| PL | 58206 | 11/2000 |
| WO | 98/59079 | 12/1998 |
| WO | 00/26420 | 5/2000 |
| WO | 00/29628 | 5/2000 |
| WO | 00/56941 | 9/2000 |
| WO | 01/73137 | 10/2001 |
| WO | 2004/081238 | 9/2004 |
| WO | 2007/027998 | 3/2007 |

* cited by examiner

ORE REDUCTION PROCESS USING CARBON BASED MATERIALS HAVING A LOW SULFUR CONTENT AND TITANIUM OXIDE AND IRON METALLIZATION PRODUCT THEREFROM

CROSS-REFERENCE TO RELATED APPLICATIONS

This application claims the benefit of Application No. PCT/US08/79761 which claims the benefit of U.S. Provisional Application No. 60/999,005, filed on Oct. 15, 2007, which is related to U.S. patent application Ser. No. 11/512,993 filed on Aug. 30, 2006 which claims the benefit of U.S. Provisional Application No. 60/788,173 filed on Mar. 31, 2006 and U.S. Provisional Application No. 60/712,556 filed on Aug. 30, 2005, which are each incorporated herein by reference in their entireties.

BACKGROUND OF THE DISCLOSURE

1. Field of the Disclosure

The disclosure relates to a process for the beneficiation of titanium oxide-containing ores. More particularly the disclosure relates to a process for reducing the ore in a moving hearth furnace to form separable iron metal and titanium oxides. The disclosure additionally relates to a titanium and iron metallization product and the product of a process for the beneficiation of titanium oxide-containing ores. More particularly the disclosure relates to a titanium oxides and iron metallization product made by a process for reducing the ore in a moving hearth furnace to form separable iron metal and titanium oxides. The separated titanium oxide is useful as feedstock for producing titanium tetrachloride, titanium dioxide for pigment or other purposes or other refined, titanium-containing products.

2. Description of the Related Art

Moving hearth furnaces have been described for use in the reduction of iron oxide. Iron oxide to be reduced is charged to the rotary hearth furnace together with a source of carbon wherein the charge is exposed to reducing conditions to form reduction products comprising iron and slag.

In using a relatively pure iron oxide charge, reactivity of molten iron oxide slag with the interior surfaces of the furnace can be a concern. Consequently, that technology tends to use amounts of carbon sufficient for solid state reduction where there is rapid and substantially complete metallization of the iron oxide before the formation, if any, of a molten phase. Consequently, if and when the product of the solid state reduction is melted, there may only be a relatively small metal oxide fraction available to form the slag component. Additionally, since the iron metal represents the majority of the reduction product, large and easily recoverable iron granules form.

A carbon bed may be provided to protect the hearth from contact with the reacting charge. Since the carbon content of the charge is sufficient to provide rapid metallization, any minor proportion of ferrous oxides that might remain to react with the carbon bed would be an incidental and insignificant part of the process.

Instead of using a rotary hearth process to reduce substantially pure iron oxide, a rotary hearth process to reduce low grade ores such as ilmenite which contain iron oxide, high levels of titanium dioxide and metal oxide impurities has been proposed for making reduction products containing metallic iron and high grade titanium oxides such as synthetic rutile. However, reducing a low grade ore such as ilmenite which contains high levels of titanium dioxide and metal oxide impurities in a rotary hearth process poses processing challenges that are not encountered when reducing relatively pure iron oxide.

When conventional rotary hearth reduction technology is used to recover metallic iron and titanium oxides from low grade ores such as ilmenite, separating the small bits of iron metal which are distributed throughout the relatively high slag content is a problem. To solve this separation problem, a first pre-reduction step to metallize the majority of the iron oxide followed by a melting step, usually in an electric melter or intermediate hearth furnace, has been described for forming more readily separable molten iron that is relatively free of gangue and a slag that contains a high titanium oxides content. However, this multi-step process is a costly and energy intensive solution.

Mechanical separation of the numerous small bits of iron metal distributed throughout the slag is impractical because the bits of iron metal tend to be well below 50 microns in diameter. Since 50 microns is the lowest practical size limit for separation by sieving, most fine sieves having 400 wire per inch sieve which is the limit for sieving 50 micron diameter particles, sieving such numerous and small bits of iron metal is not a practical separation process. Magnetic separation also becomes impractical and inefficient for particles smaller than about 50 microns. Small bits of iron can be chemically separated but chemical separation adds significantly to costs.

There is a need for an energy efficient rotary hearth process for recovering easily separable metallic iron and titanium oxides from low grade ore reduction products.

SUMMARY OF THE DISCLOSURE

The disclosure is directed to a process for producing separable iron and titanium oxides from an ore comprising titanium oxide and iron oxide, typically a low grade ore rich in titanium oxides and iron oxides, even more typically ilmenite, comprising:

(a) forming agglomerates comprising a quantity of carbon-based material and the ore, the quantity of carbon of the agglomerates being at least sufficient for forming a ferrous oxide-containing molten slag, at an elevated temperature (b) introducing the agglomerates onto a bed of carbon-based material in a moving hearth furnace, wherein the carbon-based material used for both the agglomerates and the bed have a low sulfur content;

(c) heating the agglomerates in the moving hearth furnace to a temperature sufficient for liquefying the agglomerates to produce a liquid comprising ferrous oxide-containing slag;

(d) metallizing the ferrous oxide of the slag by reaction of the ferrous oxide and the carbon of the carbon bed at a furnace temperature sufficient for maintaining the slag in a liquid state;

(e) solidifying the slag after metallization of the ferrous oxide to form a matrix of titanium oxide-rich slag having a plurality of metallic iron granules distributed there through; and (f) separating the metallic iron granules from the slag, the slag comprising greater than 85% titanium dioxide based on the total weight of the matrix after separation of the metallic iron.

Typically, the sulfur content of the carbon based material in the agglomerates and the bed is less than about 1 weight %, based on the total weight of the carbon based material.

In one embodiment, the reducing and melting of the agglomerates occurs simultaneously. Additionally, the metallizing can be carried out under conditions sufficient for small molten iron metal droplets formed in the molten slag to coalesce into large molten iron metal droplets.

The disclosure is additionally directed to a metallization product of a ferrous oxide-rich molten slag, comprising: a matrix of a titanium oxide-rich slag having a plurality of metallic iron granules distributed there through, the metallic iron granules being mechanically separable from the matrix of titanium oxide, the matrix comprising greater than 85% titanium oxides based on the total weight of the matrix after mechanical separation of the mechanically separable portion of the metallic iron.

DETAILED DESCRIPTION OF THE DISCLOSURE

Figure 1:
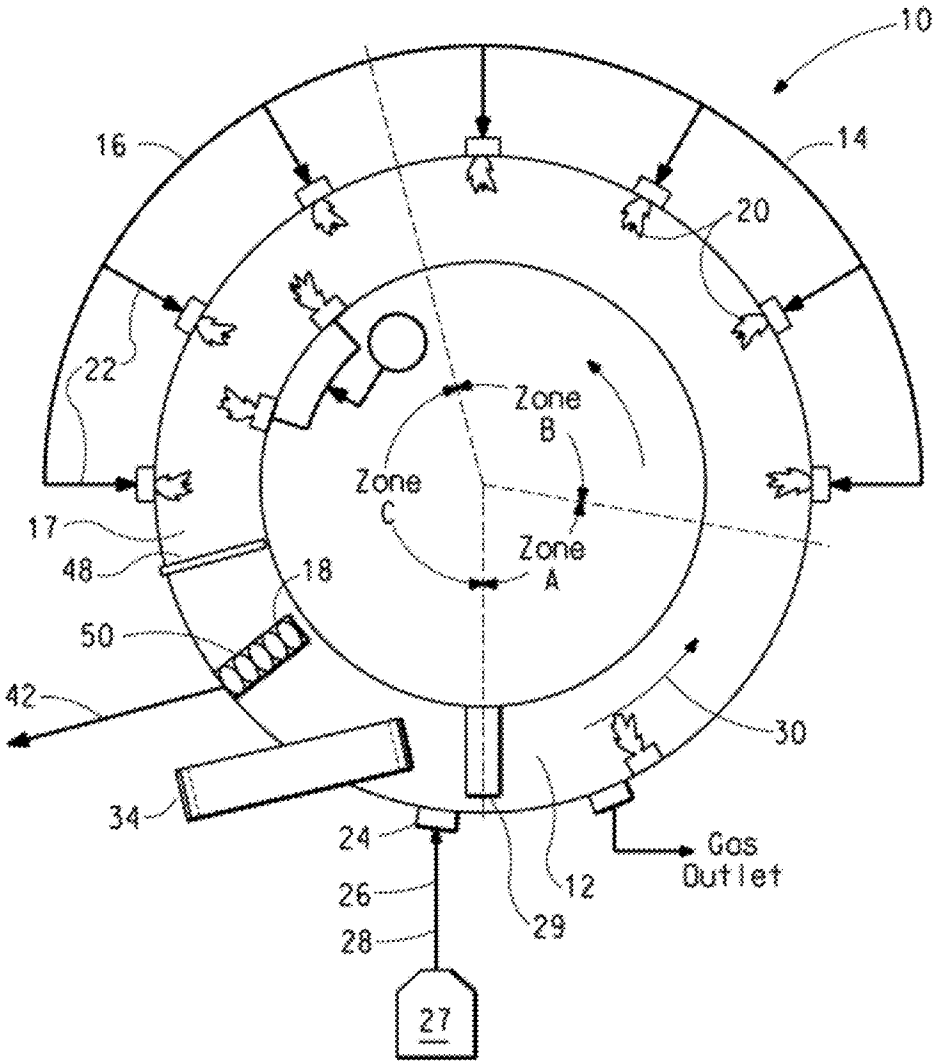
FIG. 1 is a top view of a rotary hearth furnace for the reduction of titanium-rich ores and production of iron metal and high grade titanium oxides.

The disclosure uses a low grade ore rich in titanium oxides and iron oxides. Titanium present in low grade ore occurs in complex oxides, usually in combination with iron, and also containing oxides of other metals and alkaline earth elements. Titanium is commonly found as ilmenites, either as a sand or a hard rock deposit. Low-grade titanium-rich ores, such as ilmenite sand can contain from about 45 to about 65% titanium dioxide, about 30 to about 50% iron oxides and about 5 to about 10% gangue. Rock deposits of ilmenite are reported to contain from about 45 to about 50% titanium dioxide, about 45 to about 50% iron oxides, and about 5 to about 10% gangue. The process of this disclosure can employ such titanium-rich ores.

Agglomerates, useful as the charge to the rotary hearth process, comprise the ore and a quantity of carbon sufficient for a first stage melting wherein ferric oxide reduction to ferrous oxide occurs under reducing conditions. The exact amount of carbon will vary depending upon the iron oxide content of the ore, and particularly upon the ferric oxide content, but, less than stoichiometric quantities of carbon (i.e., quantities of carbon sufficient to reduce all the iron oxides in the ore to metallic iron) are typically used so that the agglomerates will melt before a second stage metallizing wherein ferrous oxide reduction to iron metal is completed. A portion of such metallizing may occur in the first stage and is not detrimental to the process of this disclosure.

When the amount of carbon is referred to, it means the fixed carbon content of the material which provides a source of carbon. Fixed carbon content is determined in the proximate analysis of solid fuels, such as coal, by heating a sample, in the absence of air, to 950° C. to remove volatile matter (which typically includes some carbon). The carbon that remains in the ash at 950° C. is the fixed carbon content.

For a typical ore that can be used in the process of this disclosure and containing about 30 to about 50% iron oxides, the amount of carbon can range from about 0.5 to about 10.0 wt. %, more typically about 2.0 to about 8.0 wt. %, based on the total weight of the agglomerate. For ilmenite and/or sand containing ilmenite, the amount of carbon can range from about 2.0 to about 10.0 wt. %, more typically about 3.0 to about 8.0 wt. %, based on the total weight of the agglomerate. For rock deposits of ilmenite, the amount of carbon can range from about 0.5 to about 9.0 wt. %, more typically about 3.0 to about 8.0 wt. %, based on the total weight of the agglomerate.

Typically the amount of carbon in the agglomerates is sufficient for reducing the ferric oxide but insufficient to metallize all of the ferrous oxide. The quantity of carbon included in the agglomerates may be selected based on the amount of ferrous oxide that would remain in the slag phase if only the carbon in the agglomerates reacted with the iron oxides, removing oxygen as carbon monoxide. Too little ferrous oxide (too much carbon in agglomerates) produces a highly viscous slag and the iron phase particle size will be too small, making the iron difficult to separate from the Ti-rich product. Too much ferrous oxide left in slag, and the slag will spatter and run into the bed, making product recovery from the carbon bed difficult. A typical range for this calculated ferrous oxide level in the slag phase is about 0.5 to about 30 wt %, more typically about 5 to about 25 wt %, and most typically about 5 to about 20 wt %.

The carbon based material useful in the agglomerates can be any carbonaceous material such as, without being limited thereto, coal, coke, charcoal and petroleum coke. The carbon based material should not contain more than about 8 wt % ash, and typically less than about 4 wt %, and more typically less than about 1 wt. % ash, based on the total weight of the carbon based material of the agglomerate. The ash can reduce the $TiO_2$ content of the slag phase. Ash comprises non-combustibles such as $SiO_2$, $Al_2O_3$, MnO, and the like. The carbon based material can be substantially ash-free or ash-free. The lower limit of the ash content depends upon the level that can be measured by known analytical techniques. The ash content can be as low as about 0.01 wt. %.

The low sulfur carbon based material is deficient in sulfur relative to other sources of carbon which can contain significant amounts of sulfur. Typically the carbon based material of the agglomerates contains less than about 1 wt % sulfur, based on the total weight of the carbon based material of the agglomerate. Preferably the carbon based material is substantially sulfur-free, even more preferably sulfur-free. The lower limit of the sulfur content depends upon the level that can be measured by known analytical techniques. Usually the lowest amount of sulfur that can be detected by common methods is about 0.01 wt. %. Sulfur is a particularly undesirable contaminant of the carbon based material because it can degrade the phase separation between molten iron and slag. Some suitable examples of low sulfur carbon based materials include certain bituminous or anthracite coals, charcoals, metallurgical cokes, and petroleum cokes, including sponge coke, needle coke, shot coke, fluid coke, all selected for low sulfur and ash content.

Agglomerates are formed by mixing the ore and the carbon based material, optionally together with a binder material, and shaping the mixture into pellets, briquettes, extrudates or compacts that are usually dried at temperatures ranging from about 100 to about 200° C. Equipment capable of mixing and shaping the feed components are well known to those skilled in the art. Typically the agglomerates range in average diameter from about 1 to about 4 cm for ease of handling.

The optional binder material can be, without limitation thereto, organic binders or inorganic binders such as bentonite or hydrated lime. Suitable amounts of binder range from about 0.5 to about 5 wt. %, typically about 1 to about 3 wt. % based on the total weight of the agglomerates.

Unlike typical ore reduction processes, the ore of the agglomerates can be used without being ground into a fine powder. The ore may, however, be crushed and/or screened, before being formed into agglomerates, to an average particle size ranging from about 0.1 to about 1 mm to separate out any large chunks which might pose handling problems. For example, when rock deposits are used, they are usually crushed and screened to obtain ore particles ranging in average size of about 0.1 to about 1 mm.

The agglomerates are charged to a rotary hearth furnace wherein they are heated to a temperature sufficient for the first stage melting to produce a ferrous oxide-containing molten slag. In a typical process, the agglomerates are charged through a feed chute which deposits them onto a bed of carbon based material.

The carbon based material of the bed should not contain more than about 8 wt. % ash, typically less than about 4 wt. %, and more typically less than about 1 wt. % ash, based on the total weight of the carbon based material of the bed, since that can reduce the $TiO_2$ content of the slag phase, wherein ash comprises non-combustibles such as $SiO_2$, $Al_2O_3$, MnO, and the like. The carbon based material can be substantially ash-free or ash-free. The lower limit of the ash content depends upon the ash level that can be measured by known analytical techniques. The ash content can be as low as about 0.01 wt. %.

The carbon based material selected for the bed can be low in ash and low in sulfur. The low sulfur carbon based material is deficient in sulfur relative to other sources of carbon which can contain significant amounts of sulfur. Typically the carbon based material of the bed can also contain less than about 1 wt. % sulfur, based on the total weight of the carbon based material of the bed. Sulfur is a particularly undesirable contaminant because it can degrade the phase separation between molten iron and slag. Some suitable examples of low sulfur carbon based materials include certain bituminous or anthracite coals, metallurgical cokes, and petroleum cokes, including sponge coke, needle coke, shot coke, fluid coke, all selected for low sulfur and ash content. Charcoal or other porous sources of carbon may not be suitable for the bed. Calcined or uncalcined ("green") coke can be used. If green coke is used, it can be calcined in the process but it is preferable in that case to first dry the green coke. Alternatively, the coke can be calcined by depositing the green coke in a first section of the heater or furnace and allow it to calcine before adding the agglomerates.

Preferably the carbon based material of the bed is substantially sulfur-free, even more preferably sulfur-free. The lower limit of the sulfur content depends upon the level that can be measured by known analytical techniques. Usually the lowest amount of sulfur that can be detected by common methods is about 0.01 wt. %.

Because sulfur species in most carbon based materials tend to be stripped to the vapor phase at the furnace temperatures, recycling excess bed material provides a means to further reduce the effective sulfur content of the bed in use. Thus, the process can further comprise stripping the sulfur of the bed to the vapor phase during the step of heating the agglomerates in the furnace and recycling at least a portion of the sulfur-stripped bed to the bed of carbon-based material onto which the agglomerates are introduced (step (b)). The thickness of the bed can range from about 1 to about 5 cm.

The temperatures inside the moving hearth furnace sufficient for the first stage melting can range from about 1300° C. to about 1800° C., typically from about 1400° C. to about 1750° C., and more typically from about 1500° C. to about 1700° C. The particular temperature will depend on ore composition. The period of time for this melting stage can range from about 1 minute to about 5 minutes.

In the first stage, if ferric oxide is present, the carbon content of the agglomerates is sufficient to reduce the ferric oxide to ferrous oxide, but insufficient to complete reduction of ferrous oxide to iron metal.

The ferrous oxide-rich molten slag that results from the first stage melting, contacts the carbon bed under reducing conditions. Through this contact, the ferrous oxide is further reduced in the second stage metallizing to produce the iron metal product.

The temperature inside the moving hearth furnace in the second stage metallizing may be sufficiently high to keep the slag in a molten state as the ferrous oxide metallization occurs. Suitable temperatures inside the hearth furnace for this purpose can range from about 1500° C. to about 1800° C., typically from about 1600° C. to about 1750° C., and more typically from about 1600° C. to about 1700° C. The particular temperature required will vary depending upon ore composition.

For a large scale furnace, the temperature inside the furnace in the first stage can be at least about 100° C. lower than the temperature in the second stage.

The period of time for this second stage metallizing can be longer than that for the first stage melting and can range from about 3 minutes to about 20 minutes. During the first stage, reduction of ferric oxide in the presence of the carbon contained in the agglomerates and melting occur rapidly. In contrast in the second stage, allowing sufficient time for the ferrous oxide-rich molten slag to flow over the carbon bed during the metallization can enhance production of large metal particles since the iron droplets of the molten slag will coalesce into larger droplets which maintain their size during cooling to form solid metal particles.

As the second stage metallization proceeds, the slag becomes less fluid and the titanium concentration of the slag increases. The conditions sufficient for maintaining slag fluidity can help the iron droplets in the molten slag to coalesce which facilitates the formation of the easily separable large particles of iron.

The slag may solidify as the metallization approaches completion. Typically, the metallization is carried out until at least about 90% completion, based on the agglomerates, even more typically until at least about 95% completion. The iron metal that can be in the form of large granules may be readily separable from the solid slag by cost effective processes. Mechanical processes may ideally be used for separating the iron metal. Chemical processes such as chemical leaching may not be needed. Additionally extensive mechanical separation processes such as intensive grinding may not be needed.

Typical methods for separating the metal include crushing, grinding, screening and magnetic separation.

Typically the iron granules of the process range in average diameter from about 0.05 to about 10 mm, and more typically from about 0.1 to about 5 mm. The term "granules" is used to distinguish the large chunks of metallic iron produced by the process of this disclosure as compared to the small particles of metallic iron resulting from conventional processes.

Typically, the solid slag product of the process may comprise greater than about 85% titanium oxides, and more typically greater than about 87% titanium oxides, based on the total weight of the solid slag product, after separation of the mechanically separable metallic iron. The term "titanium oxides" means $TiO_2$, $Ti_3O_5$, and $Ti_2O_3$. The solid slag product may also contain smaller amounts of titanium in the form of TiO, TiC and TiN. The solid slag product may contain a minor amount of residual metallic iron. The residual metallic iron is usually the portion of metallic iron particles below about 50 microns in diameter. Usually the amount of residual metallic iron may be less than about 6%, more typically less than about 4% based on the total weight of the solid slag product, after mechanical separation of the mechanically separable metallic iron granules. There may be other small amounts of impurities such as FeO, and other oxides. The amount of these other impurities is usually less than 8% and more typically less than 6% of the total weight of the solid slag product.

The moving hearth furnace may be any furnace that is capable of exposing the agglomerates to at least two high temperature zones on a bed of carbon. A suitable furnace may be a tunnel furnace, a tube furnace or a rotary hearth furnace. The process may employ a single furnace structure.

Referring to the drawings and more particularly to FIG. 1, a rotary hearth furnace may be used for reducing the charge. A furnace 10 may be used having dimensions of a typical hearth furnace used in the iron production industry. The rotary hearth furnace has a surface 30 that is rotatable from a feed material zone 12. The surface 30 may be a refractory layer surface or a vitreous hearth layer, both of which are well known in the art of hearth furnace processing of iron ores. The surface rotates from the feed material zone through a plurality of burner zones 14, 16, 17, a reaction zone spanning at least a portion of the burner zones and a discharger zone 18 that comprises a cooling plate 48 and discharge device 28. The maximum temperature of the furnace may typically be reached in zone 17. The first and second stages of the process of this disclosure occur in the reaction zone. The surface 30 is rotatable in a repetitive manner from the discharge zone 18 to the feed material zone 12 and through the reaction zone for continuous operation. The burner zones may each be fired by a plurality of air/fuel, oil fired, coal fired or oxygen enriched burners 20 and 22.

The feed material zone 12 includes an opening 24 and a feed mechanism 26 by which the agglomerates may be charged to the furnace. A layer comprising carbon is located on at least a major proportion of the surface 30, typically the entire surface comprises a layer comprising carbon and upon which the agglomerates are placed. The layer comprising carbon may be placed on the surface by any convenient means, typically by a solid material conveyor 34. The agglomerates can be leveled to a useful height above the surface by a leveler 29 that spans the width of the surface 30. The agglomerates are continuously fed to the furnace by the feed mechanism as the surface is rotated around the furnace and through each zone. The speed of rotation may be controlled by adjusting a variable speed drive.

Figure 2:
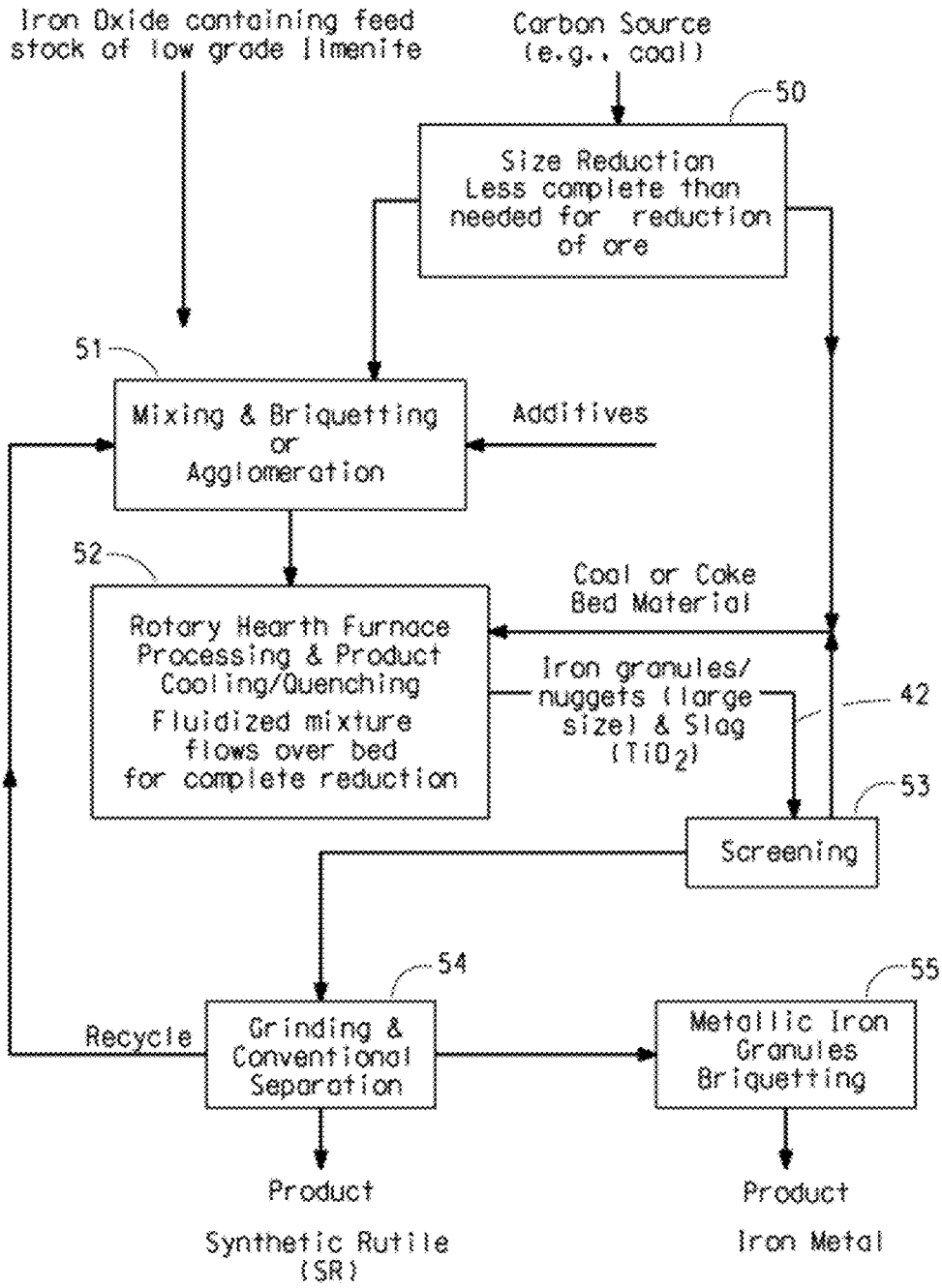
FIG. 2 is a simplified schematic diagram of the process of this disclosure.

Referring to FIG. 2, the process is shown whereby the ore is introduced to the mixing zone 51. The carbon may be introduced to a size reduction zone 50 prior to introduction to the mixing zone 51 wherein the ore and the carbon together with any optional additives, such as binders, are mixed together and formed into agglomerates. The agglomerates are introduced to rotary hearth furnace zone 52 wherein the ferric oxide of the agglomerates is reduced and metallized as described herein. The hot product 42 as shown in FIG. 1 is cooled by any convenient means. The cooled product is then screened in the screening zone 53, and then ground in grinding zone 54 to separate the iron metal from the high grade titanium oxides product. Recycle material may also be separated and introduced to the mixing zone 51. The iron metal product may be formed into briquettes in briquetting zone 55 from which the iron metal product is withdrawn.

Alternately, on a smaller scale, tube furnaces of conventional design using a high purity alumina tube as a retort may be used. These furnaces may be heated to temperatures of about 1500° C. to about 1700° C., and operated under a nitrogen or argon atmosphere.

In another embodiment of the disclosure, the carbon based material such as coal or coke particles (including but not limited to the low sulfur material) is added to the charge during the second phase metallization in order to provide more reductant contact thereby enhancing the metallization process In yet another embodiment of the disclosure the undersized slag (synthetic rutile) and iron-synthetic rutile composites are separated from the titanium oxides product and recycled to the process.

The process of this disclosure is useful for the beneficiation of titanium oxide-containing ores. More particularly, separable titanium oxide product is useful as a feedstock for producing titanium tetrachloride, particulate titanium dioxide, including but not limited to pigmentary titanium dioxide, or other refined, titanium-containing products. The titanium oxide made from this process can provide a synthetic rutile ore for the chloride process to make titanium tetrachloride from which particulate titanium dioxide can be formed by oxidizing the titanium tetrachloride in the vapor state with an oxygen-containing gas. In the chloride process the titanium oxide product of this disclosure is fed into a chlorinator reaction vessel where it is reacted with chlorine to produce a gaseous stream containing titanium tetrachloride vapor which is reacted with oxygen to product a gaseous stream containing titanium dioxide particles which can be separated to titanium dioxide for pigment. A more detailed discussion of the chloride process for producing titanium dioxide is disclosed in Vol. 24 of the Kirk Othmer Encyclopedia of Chemical Technology ($4^{th}$ Ed. 1997) and in Volume I of the Pigment Handbook, Edited by Lewis ($2^{nd}$ Ed. 1988). Useful oxidation procedures are described in U.S. Pat. Nos. 2,488,439; and 2,488,440 which are incorporated herein by reference in their entireties.

In one embodiment, the disclosure herein can be construed as excluding any element or process step that does not materially affect the basic and novel characteristics of the composition or process. Additionally, the disclosure may be construed as excluding any element or process step not specified herein.

Applicants specifically incorporate the entire content of all cited references in this disclosure. Further, when an amount, concentration, or other value or parameter is given as either a range, typical range, or a list of upper typical values and lower typical values, this is to be understood as specifically disclosing all ranges formed from any pair of any upper range limit or typical value and any lower range limit or typical value, regardless of whether ranges are separately disclosed. Where a range of numerical values is recited herein, unless otherwise stated, the range is intended to include the endpoints thereof, and all integers and fractions within the range. It is not intended that the scope of the disclosure be limited to the specific values recited when defining a range.

EXAMPLES

The following Examples illustrate the present disclosure. All parts, percentages and proportions are by weight unless otherwise indicated. Particles sizes of less than 75 microns were determined by analysis of electron micrograph images while larger sizes were determined by sieving.

Example 1

In this Example the agglomerates contained too much carbon. Tablets were prepared by mixing and compacting together, at ambient temperature, 79.7 percent by weight ilmenite ore (61% $TiO_2$, based on the total weight of the ore), and 20.3 percent coal (71% fixed carbon, based on proximate analysis) into cylinders 20 mm in diameter and 7 mm thick. Residual water was removed from the tablets by drying. The dried tablets were placed on a bed of coke breeze in an alumina crucible and moved into a tube furnace which had been heated to 1600° C. under a nitrogen atmosphere. The tube furnace is of conventional design using a high purity alumina tube as a retort. The furnace temperature dropped on the order of about 50° C. when the tablets were initially added. The temperature increased back to the starting temperature. 25 minutes after the tablets were added, the tablets were removed from the furnace and allowed to cool. The tablets retained their original shape which indicated that the tablets did not melt. Iron metallization was found to be essentially 100%. The average metallic iron particle size was about 15 microns. This iron could not be readily separated from the titanium oxide-rich phase. The size distribution of the resulting product indicated that the separation would be difficult. Attempts to separate iron particles of this size by grinding followed by magnetic separation were unsuccessful because of small particle sizes. The titanium oxide component of the resulting ground and separated product contained too much iron while the iron component contained too much titanium oxide.

Figure 3:
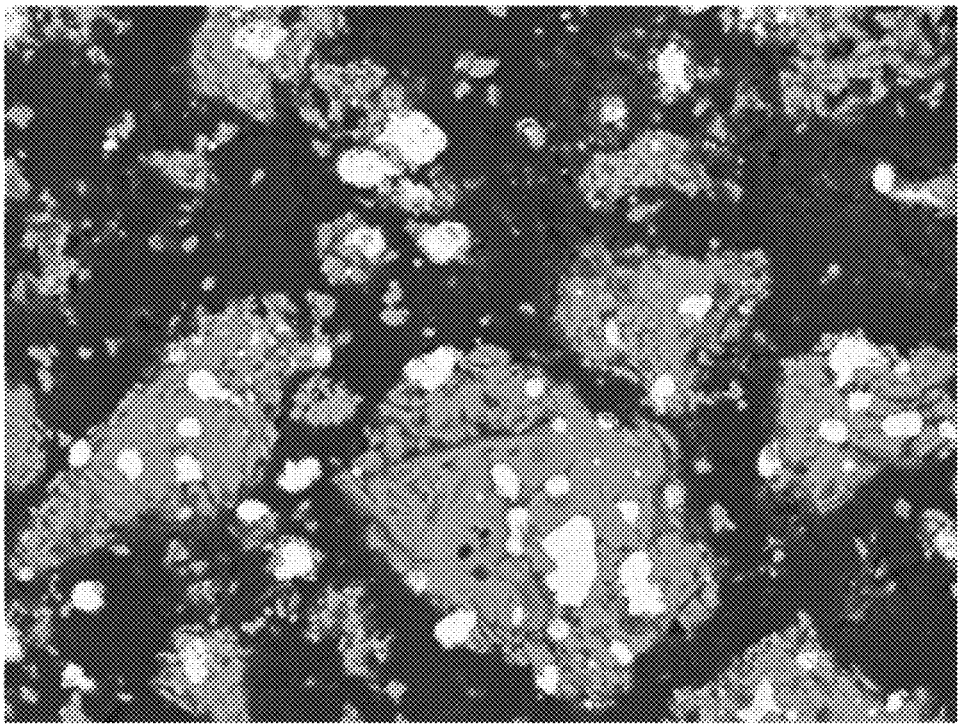
FIG. 3 is an electron micrograph of 75 micron size slag product of Example 1. Full field width is 115 microns.

An electron micrograph of full field width 115 microns of the product of this Example after grinding is shown in FIG. 3 (ground product particles were mounted in resin, cut, polished and imaged in the electron microscope such that residual iron particles appear bright and titanium oxide-rich material appears grey). As shown in FIG. 3, the slag matrix contained many small (less than 10 micron) particles of metallic iron which could not be effectively removed by typical grinding and sieving separation processes.

Example 2

In this Example the temperature inside the furnace was too low. Tablets were prepared by mixing and compacting together, at ambient temperature, 95.5 percent by weight ilmenite ore (61% $TiO_2$, based on the total weight of the ore), 3 percent coal (71% fixed carbon), and 1.5 percent wheat flour binder into cylinders 20 mm in diameter and 7 mm thick. A small amount of binder was needed because of the lower carbon content of the tablets. Residual water was removed from the tablets by drying. The dried tablets were placed on a bed of coke breeze in an alumina crucible and moved into a tube furnace which had been heated to 1600° C. under a nitrogen atmosphere. The furnace temperature dropped on the order of about 50° C. when the tablets were initially added. The temperature gradually increased back to the starting temperature. 25 minutes after the tablets were added, the tablets were removed from the furnace and allowed to cool. Distortion and glassy appearance indicated that the tablets had melted and re-solidified. Iron metallization was found to be less than 60%. The average metallic iron granule size was about 75 microns. While the metallized iron could be separated, a substantial amount of un-metallized iron remained intimately mixed with the titanium oxides.

Example 3

Tablets were prepared by mixing and compacting together, at ambient temperature, 93.5 percent by weight ilmenite ore (61% $TiO_2$), 5.5 percent coal (71% fixed carbon), and 1 percent wheat flour binder into cylinders 20 mm in diameter and 7 mm thick. Residual water was removed from the tablets by drying. The dried tablets were placed on a bed of coke breeze in an alumina crucible and moved into a furnace which had been heated to 1675° C. under an argon atmosphere. The furnace temperature dropped on the order of about 50° C. when the tablets were initially added. The temperature gradually increased back to the starting temperature. 25 minutes after the tablets were added, the tablets were removed and allowed to cool. Distortion and glassy appearance indicated that the tablets had melted and re-solidified. Iron metallization was found to be greater than 95% based on quantitative x-ray diffraction analysis. The average metallic iron granule size was more than 500 microns with 95% of the entire amount of separated granules greater than 75 microns. Nearly all of the iron could be removed from the finer, titanium oxide-rich phase by crushing and sieving with a 200 mesh sieve. Elemental analysis by inductively-coupled plasma atomic emission spectroscopy determined that the titanium oxide-rich phase contained 87% titanium oxide (titanium content reported as $TiO_2$, and the sum with remaining iron metal and other metal oxide concentrations normalized to 100%). X-ray diffraction analysis indicated that the titanium was mostly present as $Ti_3O_5$ with some $Ti_2O_3$.

Figure 4:
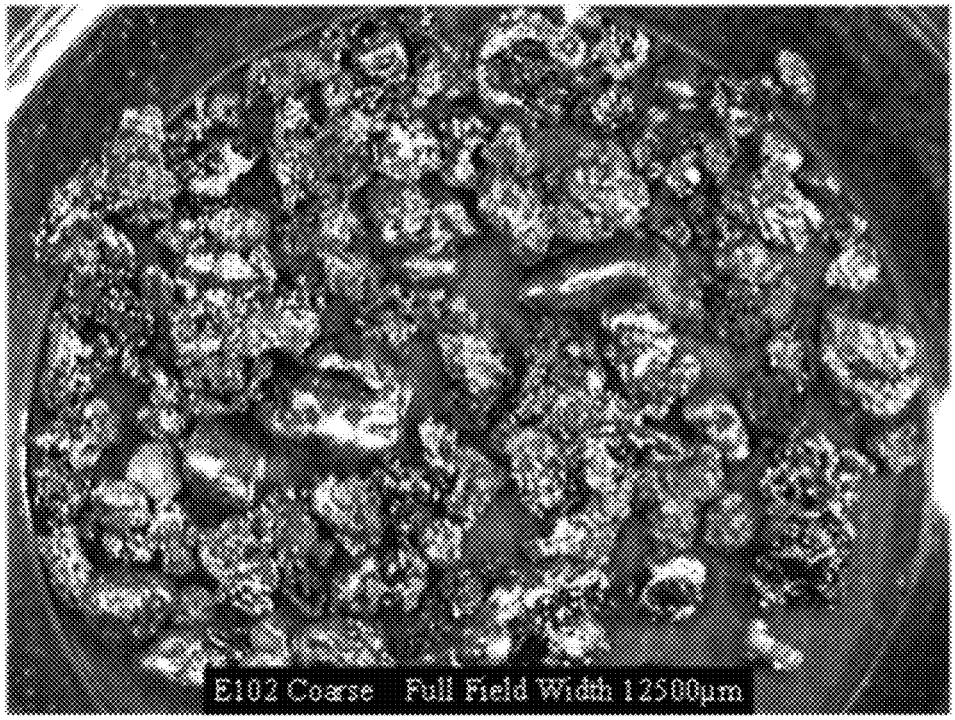
FIG. 4 is a photographic image of the separated iron granules of the product of Example 3 at full field width 12500 μm.

FIG. 4 is a photographic image (full field width 12.5 mm) of the iron granules which were mechanically separated from the product made according to Example 3.

Figure 5:
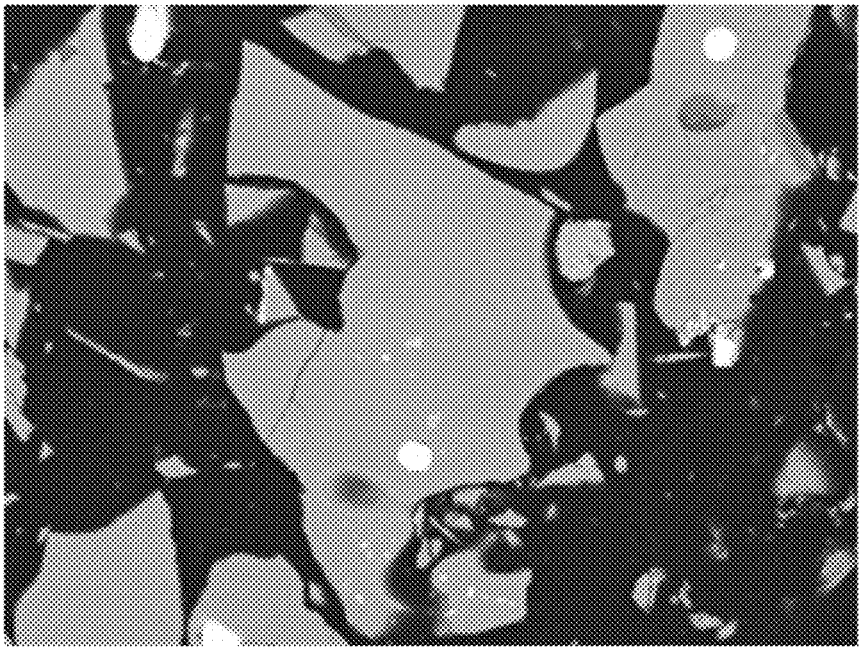
FIG. 5 is an electron micrograph of less than 75 micron size slag product after separation of iron granules of Example 3. Full field width is 115 microns.

FIG. 5 is an electron micrograph (full field width 115 microns) of the less than 75 micron slag product after grinding and removal of the iron granules by sieving (separated slag product particles were mounted in resin, cut, polished and imaged in the electron microscope such that residual iron particles appear bright and titanium oxide-rich material appears grey). Comparing FIG. 5 with FIG. 3, the ground product of FIG. 3 contained a significant content of iron metal and the iron metal particles were small, making them difficult to separate by mechanical means. However, the slag product shown in FIG. 5 shows few particles of iron metal remaining within the solid slag product after separation of the larger iron metal granules (FIG. 4) by grinding and sieving.

Figure 6:
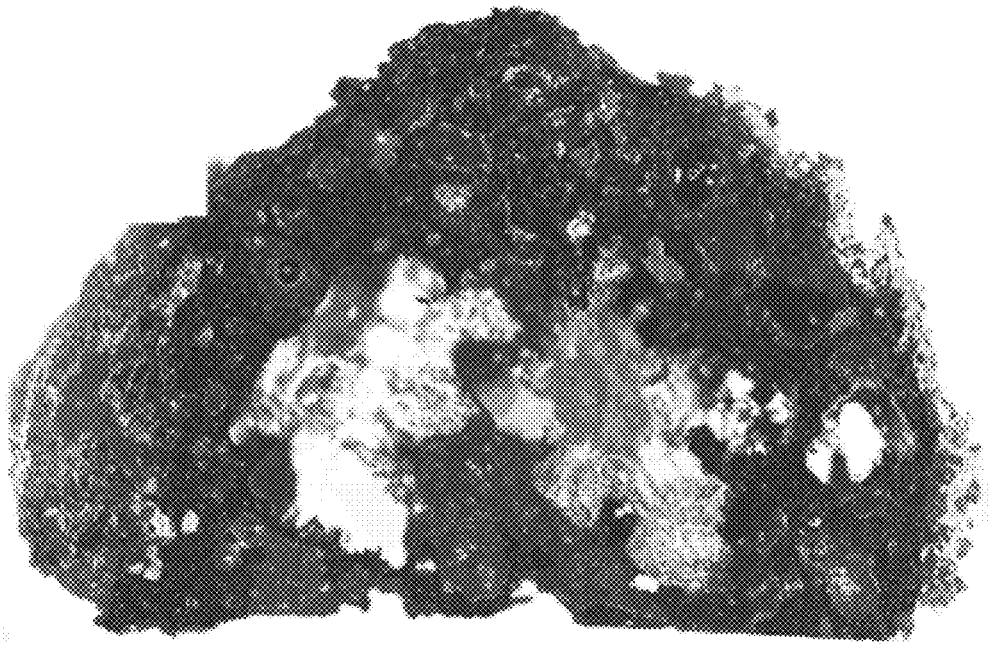
FIG. 6 is an optical micrograph of a metallization product of a process similar to Example 3 before grinding.

FIG. 6. is a polished cross section of a product of a process similar to Example 3 before grinding. Even at the relatively large scale of the figure, some of the iron granules are visible.

Example 4

A series of tests was conducted in a larger furnace to explore the effect of sulfur content in bed carbon by using two different petroleum cokes. Results of the tests, which used low sulfur (~0.6%) and high sulfur (~4.5%) bed coke for the reduction of pellets containing ilmenite and low ash coal at 1700° C., illustrate the effect of sulfur on the products of carbothermal reduction.

The tests were conducted in a box furnace unit custom-built for carbothermal reduction experiments. In the experiments, pellets containing 92.5% ilmenite (60% $TiO_2$ content), 5.5% coal, having a sulfur content of about 0.66 wt. %, and 2% binder were placed on a bed of calcined petroleum coke and then heated to a temperature in the range of 1700-1725° C. for a period of up to 15 minutes. The reduction of ilmenite resulted in the generation of carbon monoxide gas, and produced a product that was molten at the test temperature and comprised a mixture of metallic iron and titanium oxides (the slag-iron matrix). This mixture was separated by grinding and magnetic separation. The split between slag and metal depended both on the extent of reduction of ilmenite and the ability to separate the two. Separability depended strongly on the presence of sulfur.

Figure 7:
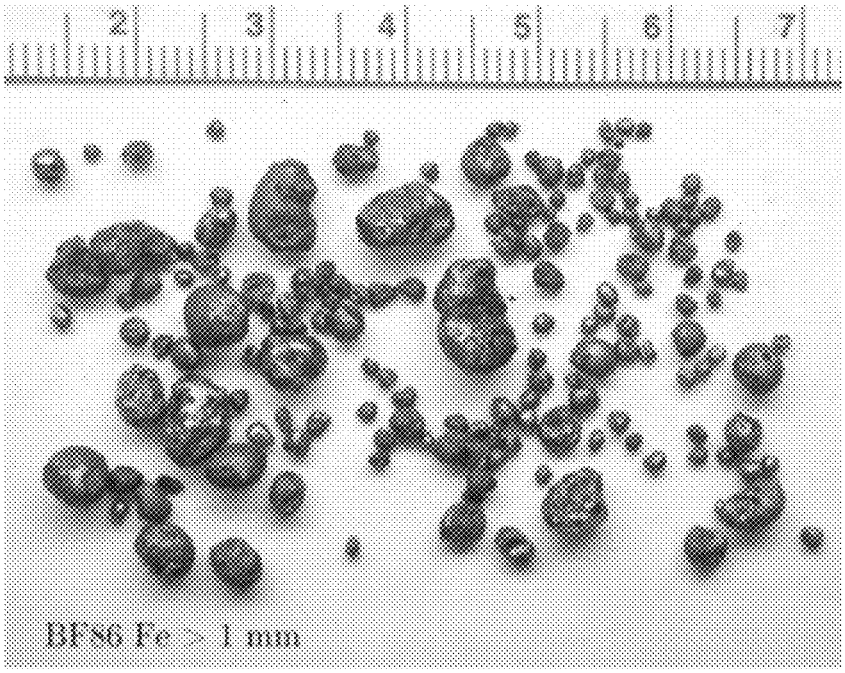
FIG. 7 shows coarse iron particles produced after 8 minutes at 1700° C. on a low sulfur bed (scale is in centimeters).
Figure 8:
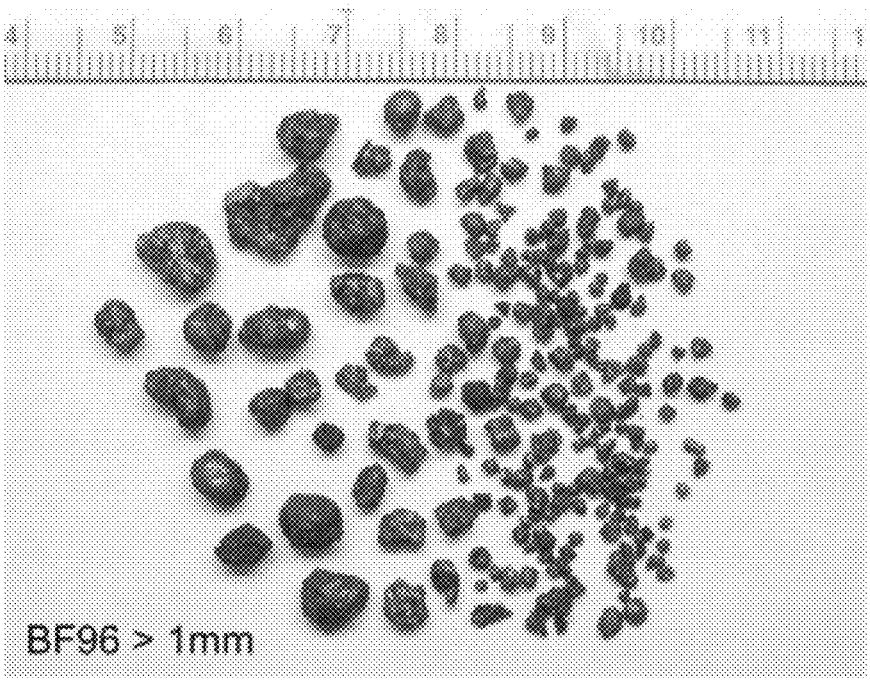
FIG. 8 shows coarse iron particles produced after 11 minutes at 1700° C. on a low sulfur coke bed (scale is in centimeters).

Tests using the low sulfur bed material were run for periods of 5, 7, 8, 9, 10, 11, 12 and 13 minutes at 1700° C., and for 8 and 10 minutes at 1725° C. These tests generally produced clean metal particles easily separated from the slag. An example of the appearance of the iron metal particles produced after 8 minutes at 1700° C. is shown in FIG. 7. The iron particles were mostly spherical in nature and showed no indication of the attachment of slag particles. Even after 11 minutes the coarse iron particles were substantially spherical in appearance and had little indication of attached slag (see FIG. 8).

Figure 9:
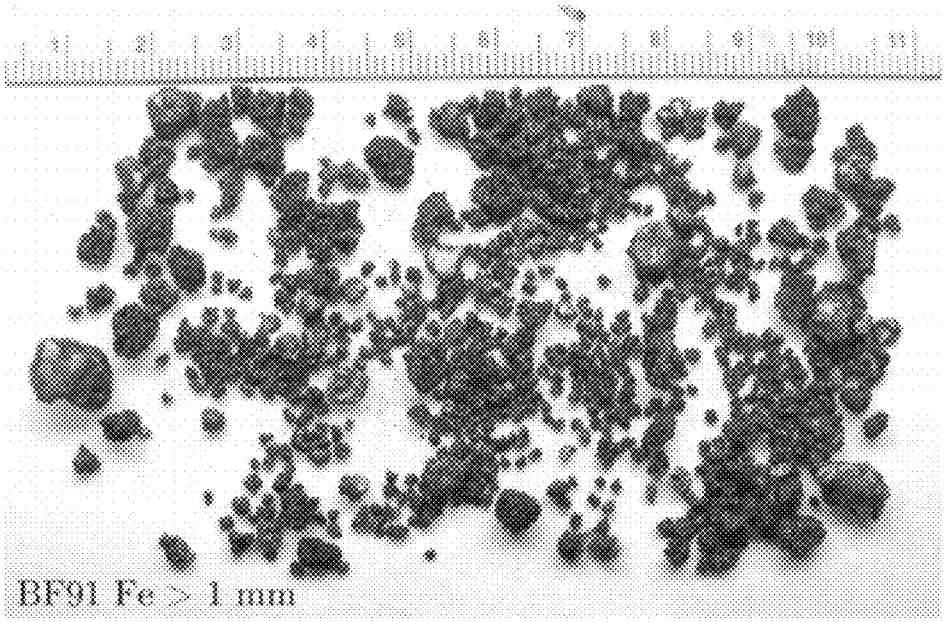
FIG. 9 shows coarse iron particles produced after 8 minutes at 1700° C. on a high sulfur coke bed (scale is in centimeters).

By contrast, runs with the high sulfur bed coke, at times greater than about 6 minutes, produced poor slag/metal splits, poor slag quality, and the coarse iron particles were of poor quality (shorter times resulted in incomplete iron metallization). The tests were run for periods of 5, 6, 8, and 10 minutes at 1700° C. An example of the coarse iron produced after 8 minutes (comparable to FIG. 7) is shown in FIG. 9 below. There were few substantially spherical iron particles, and most of the particles showed indications of the attachment of slag.

Results of the experimental runs of this Example are reported in Table 1 below (wherein "PSD" means "particle size diameter").

Table 1 summarizes the splits between slag and iron metal for a number of low sulfur and high sulfur runs. In all the examples of Table 1, the furnace product was ground and separated by a consistent protocol comprising two stages of hammermill grinding with an intervening external screening, followed by a magnetic separation step. The contrast between the splits for the 10 minute runs is particularly striking. The split for the low sulfur run at 10 minutes is 73% slag, 27% metal (close to a theoretical split for the 60% $TiO_2$ ore used), and the slag quality is high. The high sulfur run at 10 minutes has a very poor split: 51% slag, 49% metal, and the slag purity is lower.

TABLE 1

Effects of Bed Carbon Sulfur Content

| Hearth Coke Sulfur level | Temp. ° C. | Time at Temp. minutes | Product Split Slag % | Product Split Metal % | Slag Purity $TiO_2$ % | Slag Particle Size Distribution (PSD) <75 microns | $d_{50}$ | $d_{90}$ | Metal PSD <75 microns | Metal PSD >1 mm |
|---|---|---|---|---|---|---|---|---|---|---|
| High | 1700 | 5 | 72 | 28 | 80.3 | 15% | 135 | 318 | 15% | 38% |
| High | 1700 | 6 | 79 | 21 | 79.4 | 20% | 175 | 629 | 1% | 28% |
| High | 1700 | 8 | 65 | 35 | 84.6 | 14% | 202 | 569 | 4% | 64% |
| High | 1700 | 10 | 51 | 49 | 86.8 | 7% | 231 | 709 | | |
| Low | 1700 | 6 | 78 | 22 | 79.9 | 7% | 249 | 430 | 25% | 40% |
| Low | 1700 | 7 | 81 | 19 | 84.1 | 10% | 218 | 418 | 2% | 70% |
| Low | 1700 | 8 | 81 | 19 | 86.5 | 9% | 206 | 405 | 3% | 80% |
| Low | 1700 | 9 | 75 | 25 | 88.4 | 9% | 214 | 459 | 4% | 72% |
| Low | 1700 | 10 | 73 | 27 | 88.7 | 9% | 227 | 488 | 5% | 61% |
| Low | 1700 | 10 | 70 | 30 | 89.5 | 10% | 201 | 384 | 5% | 48% |
| Low | 1700 | 11 | 71 | 29 | 89.6 | 5% | 223 | 456 | 4% | 60% |
| Low | 1700 | 12 | 74 | 26 | 89.4 | 7% | 228 | 488 | 2% | 66% |
| Low | 1700 | 13 | 63 | 37 | 89.7 | 7% | 205 | 341 | | 41% |
| Low | 1725 | 8 | 76 | 24 | 87.7 | 11% | 219 | 473 | 4% | 54% |
| Low | 1725 | 10 | 65 | 35 | 90.1 | 7% | 214 | 427 | | 40% |

Figure 12:
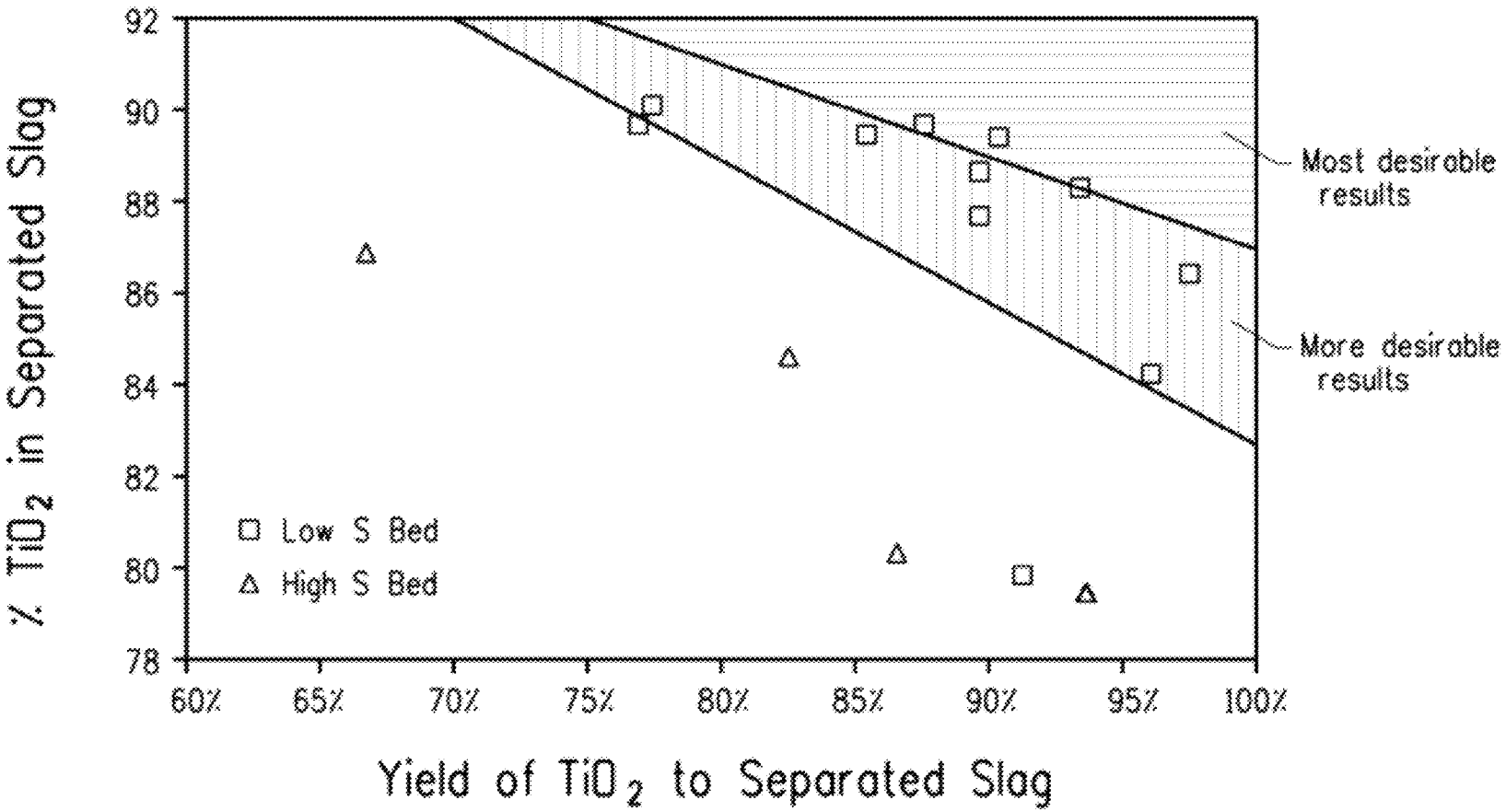
FIG. 12 shows the purity vs. yield trade off improvement with low sulfur carbon based materials.

$TiO_2$ yields, calculated using data from Table 1, were plotted as the horizontal axis in FIG. 12, which illustrates the improvement from using low sulfur coke. Because both high yield and high purity are important, most desirable results are those closer to the upper right-hand corner of the diagram of FIG. 12.

Figure 10:
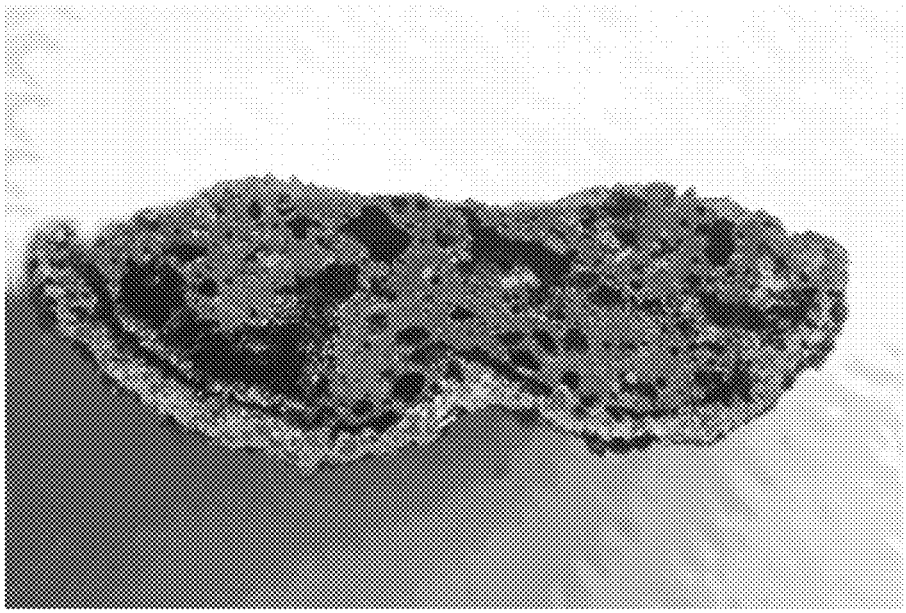
FIG. 10 shows a typical cross section of un-separated slag-iron matrix from high sulfur carbon bed.

The cross-sections of the slag-iron matrix from experiments with the high sulfur coke bed were also instructive. They showed that at short exposure times, for example, 5 minutes, substantially spherical iron particles. However, after an exposure period of 6 minutes there was little evidence of substantially spherical iron. Instead, iron was spread out on the base of the sample, comingled with coal particles and slag. Longer exposure periods resulted in further spreading of iron, until it constituted an almost continuous layer on the base of the sample, with particles of coke and slag intermingled in the layer. A typical cross section from a high sulfur bed experiment is show in FIG. 10.

Figure 11:
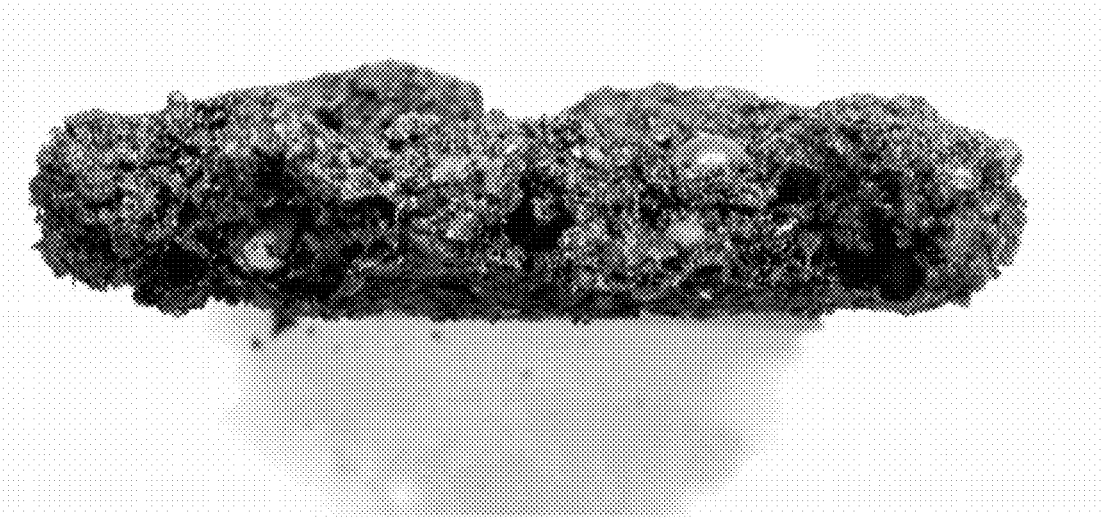
FIG. 11 shows a typical broken view of un-separated slag-iron matrix from low sulfur carbon bed.

The cross-sections of the slag-iron matrix from low sulfur experiments showed no evidence of the spreading of iron on the base of the sample. Discrete, substantially spherical iron particles were generally observed in the cross-sections from the low sulfur coke beds. These are apparent in the typical broken section shown in FIG. 11.

The description of illustrative and preferred embodiments of the present disclosure is not intended to limit the scope of the disclosure. Various modifications, alternative constructions and equivalents may be employed without departing from the true spirit and scope of the appended claims.

What is claimed is:

1. A process for producing separable iron and titanium oxides from an ore comprising titanium oxide and iron oxide, comprising:

(a) forming agglomerates comprising a quantity of carbon-based material and the ore, the quantity of carbon of the agglomerates being at least sufficient for forming a ferrous oxide-containing molten slag, at an elevated temperature (b) introducing the agglomerates onto a bed of carbon-based material in a moving hearth furnace, wherein the carbon-based material used for both the agglomerates and the bed have a low sulfur content that is less than about 1 wt. %, based on the total weight of the carbon based material;

(c) heating the agglomerates in a moving hearth furnace to a temperature sufficient for liquefying the agglomerates to produce a liquid comprising ferrous oxide-containing slag;

(d) metallizing the ferrous oxide of the slag by reaction of the ferrous oxide and the carbon of the carbon bed at a furnace temperature sufficient for maintaining the slag in a liquid state;

(e) solidifying the slag after metallization of the ferrous oxide to form a matrix of titanium oxide-rich slag having a plurality of metallic iron granules distributed there through; and (f) separating the metallic iron granules from the slag, the slag comprising greater than 85% titanium dioxide based on the entire weight of the matrix after separation of the metallic iron;

wherein sulfur is stripped off the bed of the carbon-based material in step (c) and forming a sulfur-stripped bed of carbon-based material that is recycled to the bed of carbon-based material onto which the agglomerated are introduced in step (b).

2. The process of claim 1 wherein the ore is a low grade ore.

3. The process of claim 2 wherein the low grade ore is rich in titanium oxides and ferric oxide.

4. The process of claim 3 wherein the low grade ore is ilmenite.

5. The process of claim 4 wherein the ore is ilmenite sand and the amount of carbon of the agglomerates ranges from about 0.5 to about 10.0 weight percent, based on the entire weight of the agglomerates.

6. The process of claim 4 wherein the ore is ilmenite rock and the amount of carbon of the agglomerates ranges from about 0.5 to about 9 weight percent, based on the entire weight of the agglomerates.

7. The process of claim 1 wherein the agglomerates have a quantity of carbon that is less than a stoichiometric quantity.

8. The process of claim 1 wherein the ore contains about 30 to about 50% iron oxides.

9. The process of claim 8 wherein the amount of carbon of the agglomerates ranges from about 0.5 to about 10 weight percent, based on the entire weight of the agglomerates.

10. The process of claim 1 wherein the agglomerates comprise a plurality of ore particles ranging in average particle size diameter from about 0.1 to about 1.0 mm.

11. The process of claim 1 wherein the temperature sufficient for liquefying the agglomerates to produce a liquid comprising ferrous oxide-containing slag of step (c) ranges from about 1300° C. to about 1800° C.

12. The process of claim 1 wherein the temperature sufficient for liquefying the agglomerates to produce a liquid comprising ferrous oxide-containing slag of step (c) ranges from about 1500° C. to about 1800° C.

13. The process of claim 1 wherein the reducing and melting of the agglomerates occurs simultaneously.

14. The process of claim 1 wherein the metallizing is carried out under conditions sufficient for small molten iron metal droplets formed in the molten slag to coalesce into large molten iron metal droplets.

15. The process of claim 14 wherein the large molten iron metal droplets range in average diameter from about 0.05 to about 10 mm.

16. The process of claim 1 wherein the furnace is a tunnel furnace, a tube furnace or a rotary hearth furnace.

17. The process of claim 1 wherein the carbon-based material is sulfur free.

18. The process of claim 1 wherein the carbon-based material used for both the agglomerates and the bed have an ash content less than about 8 wt. %, based on the entire weight of the carbon-based material.

19. The process of claim 1 wherein the carbon-based material used for both the agglomerates and the bed have an ash content that is less than about 4 wt. %, based on the entire weight of the carbon-based material.

20. The process of claim 1 wherein the carbon-based material used for both the agglomerates and the bed have an ash content that is less than about 1 wt. %, based on the entire weight of the carbon-based material.

* * * * *